US006363553B1

(12) United States Patent
Baumgärtel et al.

(10) Patent No.: US 6,363,553 B1
(45) Date of Patent: Apr. 2, 2002

(54) ANTIALLERGENIC COVERING FOR RECEIVING OBJECTS CONTAMINATED WITH ALLERGENS AND/OR FINE DUST ABSORBED INTO THE LUNG

(75) Inventors: Falko Baumgärtel, Steinfurt; Ulrich Vopel, Flammersfeld, both of (DE)

(73) Assignee: Lohmann GmbH & Co. KG, Neuwied (DE)

( * ) Notice: Subject to any disclaimer, the term of this patent is extended or adjusted under 35 U.S.C. 154(b) by 0 days.

(21) Appl. No.: 09/555,992

(22) PCT Filed: Nov. 21, 1998

(86) PCT No.: PCT/EP98/07506

§ 371 Date: Sep. 1, 2000

§ 102(e) Date: Sep. 1, 2000

(87) PCT Pub. No.: WO99/30594

PCT Pub. Date: Jun. 24, 1999

(30) Foreign Application Priority Data

Dec. 13, 1997 (DE) ..... 197 55 498

(51) Int. Cl.[7] ..... A47C 27/80; A47G 9/00
(52) U.S. Cl. ..... 5/482; 5/699; 5/738; 5/939
(58) Field of Search ..... 5/482, 699, 939, 5/496, 737, 738, 490

(56) References Cited

U.S. PATENT DOCUMENTS 4,730,759 A 3/1988 Naidu ..... 5/98.1
5,321,861 A 6/1994 Dancey et al. ..... 5/482
5,950,264 A * 9/1999 Wyner et al. ..... 5/939
5,966,759 A * 10/1999 Sanders et al. ..... 5/699

FOREIGN PATENT DOCUMENTS

| | | |
|---|---|---|
| EP | 0 600459 A1 | 12/1993 |
| WO | 0323116 A1 | 7/1989 |
| WO | WO 96/21379 A1 | 7/1996 |
| WO | 19728123 A1 | 7/1999 |

* cited by examiner

*Primary Examiner*—Alexander Grosz
(74) *Attorney, Agent, or Firm*—Jordan and Hamburg LLP

(57) ABSTRACT

The allergen-inhibiting encasing for receiving objects contaminated with respirable fine and extremely fine dust, house dust, moulds and allergens, e.g. excretions of house dust mites, together with air, especially bedding and/or upholstery of all kinds, comprising at least a web of woven fabric or a nonwoven and a mechanical closure, such as a zip fastener, in a configuration blocking the passage of allergens and extremely fine particles. The encasing is characterized in that the web includes a fabric which is coated with polyurethane-acrylate copolymer foam and is equipped with increased density, by calendering, up to a degree of filtration of almost 100% for particles smaller than 1 $\mu$m. Also, the zip fastener is sealed on the inner face of the encasing by overlapping with a sealing strip comprising at least three plies of fabric.

25 Claims, 1 Drawing Sheet

ANTIALLERGENIC COVERING FOR RECEIVING OBJECTS CONTAMINATED WITH ALLERGENS AND/OR FINE DUST ABSORBED INTO THE LUNG

BACKGROUND OF THE INVENTION

The invention relates to an allergen-inhibiting encasing for receiving objects contaminated with respirable fine dust and extremely fine dust, house dust, moulds and allergens, e.g. excretions of house dust mites, together with air, especially bedding and/or upholstery of all kinds. The encasing has at least one web of woven fabric or nonwoven and a mechanical closure such as a zip fastener, in a configuration blocking the passage of allergens and extremely fine dust.

With allergen-inhibiting encasings intended to receive the aforementioned objects, the encasings must on the one hand be air-permeable to a limited extent and on the other hand are to prevent contamination of the surrounding air with respirable fine or extremely fine dust and allergens. It is, inter alia, necessary to clean the encasing in regular intervals. For this reason, such encasings must be provided with a suitable closure system which is easy to handle, suitable for repeated use and likewise allergen-inhibiting. It must be capable of diminishing the excess pressure, which occasionally occurs within the encasing upon volume reduction such as that caused by pushing or kneading movements. Preferably, the diminishing of the excess pressure should be gradual enough for the sudden change of pressure both in the region of the textile web as well as of the closure systems to be uniformly low, so that no respirable fine dust and allergens may be emitted thereby.

It is known to provide an almost air-impermeable encasing for bedding and upholstery with a zip fastener which can, in addition, be sealed by means of a pressure-sensitive adhesive tape suitable for multiple repeated closing. To this end, the constitution of the web material must have comparatively satisfactory air permeability with simultaneous particle impermeability to respiratory fine dust in the range of <10 $\mu$m (U.S. Pat. No. 5,321,861).

In WO 96/21379 there is described an allergen-inhibiting encasing wherein the upper part of the enclosed space consists of a dense, coated material, whereas the bottom side consists only of a dense material whose air impermeability is greater than that of the zip fastener and through which air can emerge more easily than through the zip fastener. Here, too, however, the prerequisite must be met that the fabric of the bottom side has a comparatively high particle imperviousness to respirable fine dust.

In EP 0 600 459 A1 there is described an allergen-inhibiting encasing with a zip fastener of a polyethylene nonwoven (Tyvek) wherein at least one overlapping portion of the web in front of and/or behind the zip fastener is intended to provide a reliable seal. To achieve this it would, however, in any case be necessary for the far-projecting, overlapping web portions to rest planar with the zip fastener to be sealed, both against the inner face as well as against the outer face of the encasing, which, given the common use of bedding, is frequently not the case.

A difficulty of all known solutions is that the web material which is to be used for the allergen-inhibiting encasing must on the one hand possess a comparatively high permeability to air and water vapor and on the other hand a high degree of impermeability to particles. These requirements are contradictory in terms of physics since high air permeability is inevitably connected with a reduction of the particle impermeability. Insufficient particle impermeability can lead to respiratory tract symptoms as a result of aerogenic contact with extremely fine dust loaded with allergens of the aforementioned type, and as a result of emerging natural rubber latex products. Here, the trigger substances are proteins which attach to dust particles and which to a substantial extent are present in particle sizes smaller than 1 $\mu$m.

SUMMARY OF THE INVENTION

It is the object of the present invention to configure an allergen-inhibiting encasing such that a material of a web of the encasing filters out particle sizes of smaller than 1 $\mu$m and thus inevitably has a comparatively low air permeability. A closure system of the encasing at the same time is configured such that on the one hand it can be repeatedly operated many times and thus prevents the occurrence, upon ejection of air, of an increased flow rate through the closure system, with the result that allergenic dust and extremely fine particles are not emitted in concentrations above the permissible or acceptable limits, while the encasing nevertheless has a satisfactory water vapor permeability which markedly improves sleeping comfort. This also prevents the formation of moulds due to accumulation of moisture in the interior of the encasing.

DETAILED DESCRIPTION OF THE INVENTION

Figure 1:
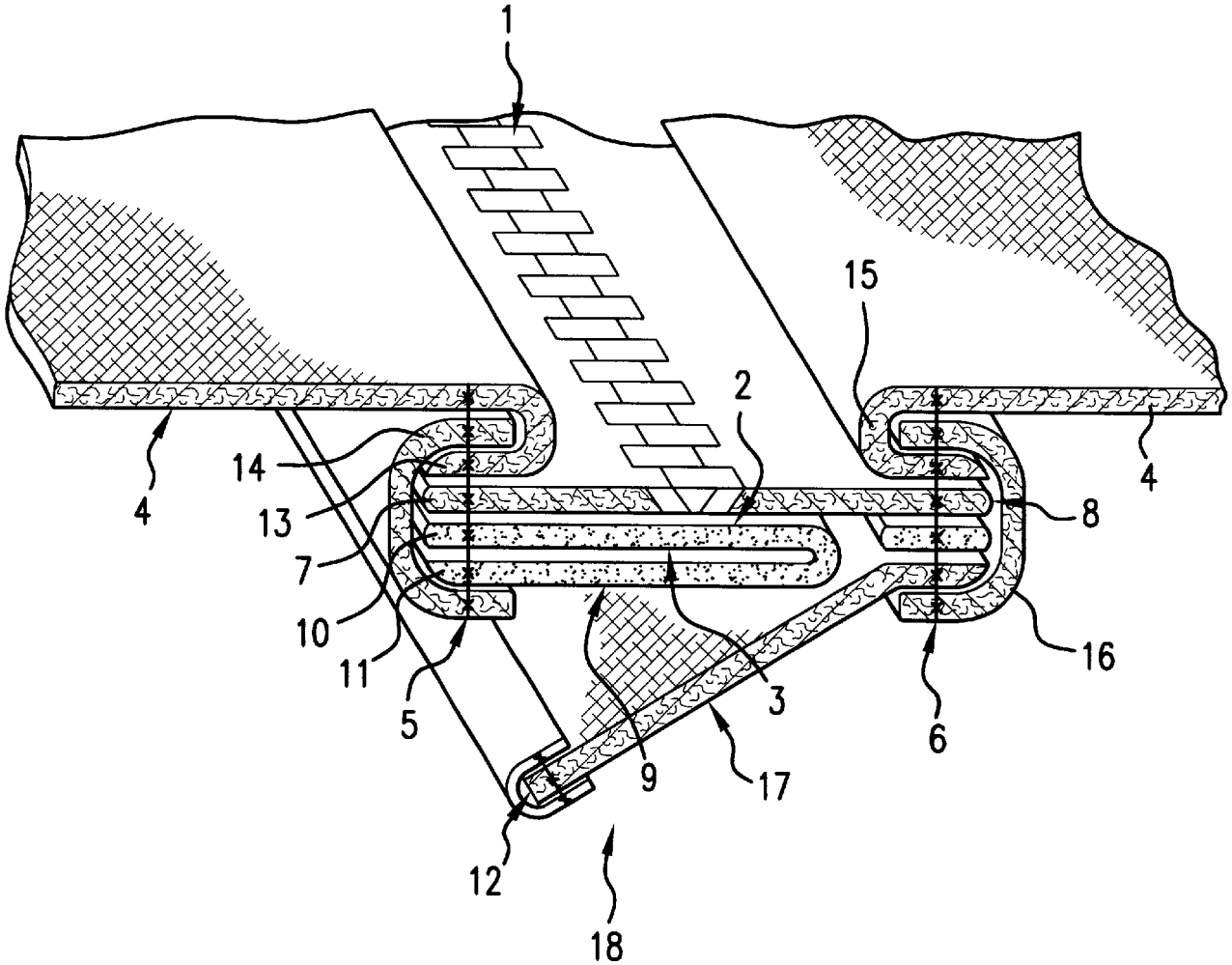
FIG. 1 is a cross-sectional view of an allergen-inhibiting encasing of the present invention.

To achieve the object of the invention in an allergen-inhibiting encasing of the present invention the encasing has a web which includes a fabric which is coated with polyurethane-acrylate copolymer foam and is equipped with increased density, by calendering, yielding a degree of filtration of almost 100% for particles smaller than lAm. A zip fastener is sealed on an inner face of the encasing by overlapping with a sealing strip comprising at least three plies of fabric. The fabric of the web preferably has a high water vapor permeability and has an air permeability of not greater than 240 liters/m$^2$/min at 196 Pa.

By means of the configuration of the allergen-inhibiting encasing according to the present invention it is reliably ensured that upon occurrence of excess pressure in the encasing there are emitted into the surrounding air only such amounts of respirable fine dust as are clearly below the permissible and acceptable limits for individuals having allergies.

To this day, only few limits have been defined in the literature of allergy research. For individuals with highly sensitive house dust mite allergies there is a threshold indication of about 10 ng/m$^3$ of air. For latex allergies there is no clearly defined value available. The imperviousness of the system, however, prevents allergens (proteins of natural rubber latex products) attached to fine dust particles smaller than 10 $\mu$m from being emitted from the encasing in impermissible concentrations. Due to the fact that the zip fastener is sealed on the inner face of the encasing by overlapping with a sealing strip comprising at least three layers of fabric, the sealing strip, upon occurrence of excess pressure between the encasing and the surrounding atmosphere, places itself against the zip fastener in a non-positive connection, and forces the air to diffuse through the three layers of fabric. Here, too, a degree of filtration of almost 100% for particles smaller than 1 $\mu$m is ensured.

Advantageous embodiments of the zip fastener sealing are provided in which it is also possible to equip the encasing with seams having allergen-inhibiting impermeability.

One use of the encasing according to the invention provides for bedding for individuals with allergies that is enclosed, and also provides for covers for latex mattresses that are for protection against latex allergies.

Further details, features and advantages of the invention are evident from the following explanation of an embodiment which is schematically illustrated in FIG. 1.

The represented detail of the allergen-inhibiting encasing according to the invention for receiving objects contaminated with respirable fine dust, house dust, moulds and allergens, e.g. excretions of house dust mites, together with air, especially bedding and/or upholstery of all kinds, comprises web portions 4 of woven or nonwoven fabric and a mechanical closure in the form of a zip fastener 1, in a configuration which blocks the passage of allergens and extremely fine particles. To this end, it is provided that the web 4 includes a fabric which is coated with polyurethane-acrylate copolymer foam and is provided with increased density, by calendering, up to a degree of filtration of almost 100% for particles smaller than 1 $\mu$m. The zip fastener 1 is sealed on the inner face of the encasing by overlapping 2 with a sealing strip 3 which comprises at least three plies of fabric 10, 11 and 12. To this end, there is provided a configuration having the sealing strip 3 wherein the sealing strip 3 starts from a lateral seam 5 between one of the zip fastener tapes 7 and a hem 13 of the web of fabric 4. The lateral seam 5 is crimped over towards the inner face of the encasing, as well as a welting thereof, by a hemming tape 14. The sealing strip 3 is connected thereto and is in the form of a tongue 9. The tongue 9 is folded in the shape of a hairpin, by means of the joint, particle-proof lateral seam 5. The lateral seam 5 preferably has allergen-inhibiting impermeability. There is provided on the other side of the zip fastener 1 a sealing configuration of a further, at least single-layered, sealing strap 17 connected by means of a joint seam 6. The sealing strap 17 is disposed such that it overlaps the entire width of the opposite sealing strip 3. The sealing strap 17 starts from joint seam 6 which is opposite lateral seam 5. The joint seam 6 is between a zipper tape 8 and a hem 15 of the web of fabric 4. The hem 15 is crimped over towards the inner face of the encasing and a welting with a hemming tape 16.

It is evident from the above detailed description that when there is a drop in pressure between the inner faces of the encasing corresponding to the direction of arrow 18, the sealing strap 17, in cooperation with the sealing strip 3, which is configured as a tongue 9, is moved to an abutting position in nonpositive connection with the bottom side of the zip fastener 1. This achieves almost 100% sealing of the zip fastener 1. On the other hand, however, both the sealing strap 17 as well as the tongue 9 are attached underneath the zip fastener 1 such that they in no way impede the opening or closing of the zip fastener 1 when being operated from the outside by means of an appropriate closing member (not shown). Since the lateral seam 5, fabric plies 10, 11, hem 13, and hemming tape 14 are united by a joint lateral seam 5, and the corresponding, opposite elements by the common joint seam 6, the encasing also ensures an uncomplicated manufacture. The present invention represents an optimum solution to the task of blocking the passage of allergens and extremely fine dust.

What is claimed is:

1. An allergen-inhibiting encasing for objects contaminated with respirable fine particles and allergens comprising:

a web having an inner face and having portions defining an opening and including fabric which is coated with foam having a density such that the fabric provides for filtration of particles smaller than 1 $\mu$m;

a closure device extending along said opening for opening and closing of said encasing thereby allowing for placement of the object in said encasing; and a sealing strip overlapping said closure device and connected to the inner face of the web, said sealing strip comprising at least three plies of a fabric.

2. The encasing of claim 1 wherein the fabric of the web has an air permeability of not greater than 240 liters/m$^2$/min at 196 Pa.

3. The encasing of claim 1 wherein the fabric of the web has a high water vapor permeability.

4. The encasing of claim 1 wherein the encasing further comprises a lateral seam having allergen-inhibiting impermeability and configured such that said sealing strip and said web are connected to each other along said lateral seam.

5. A method for protection against allergies comprising encasing an object contaminated with respirable fine particles and allergens in the encasing of claim 1.

6. The method of claim 5 wherein the encasing comprises a cover for a latex mattress for protection against latex allergies.

7. An allergen-inhibiting encasing for an object contaminated with respirable fine particles and allergens comprising:

a web having an inner face and having portions defining an opening and having a hem extending along said opening, said web including a fabric coated with foam having a density such that it provides for filtration of particles less than 1 $\mu$m;

a closure device including a zipper tape connected to said web at said hem, said closure device extending along said opening for opening and closing of said encasing thereby allowing for placement of the object in said encasing;

a sealing strip overlapping said closure device and connected to the inner face of the web at said hem, said sealing strip comprising at least three plies of a fabric;

a hemming tape provided over said hem on the inner face of said web, said zipper tape, and a side of said sealing strip; and a lateral seam configured such that said hem, said zipper tape, said hemming tape and said sealing strip are connected with each other along said lateral seam.

8. The allergen-inhibiting encasing of claim 7 wherein:

the closure device further includes a second zipper tape opposite said lateral seam across said opening and connected to said web; and said sealing strip includes a sealing strap formed from at least a single layer of material of said three plies, said sealing strap being disposed such that said sealing strap overlaps a remaining portion of said sealing strip and includes another side of said sealing strip; and said encasing further comprises:

a second hem extending along said opening disposed opposite said lateral seam across said opening and connected to said second zipper tape;

a second hemming tape provided over said second hem on the inner face of said web, said second zipper tape, and said another side of said sealing strip; and a joint seam configured such that said second hem, said second zipper tape, said second hemming tape and said another side of said sealing strap are connected with each other along said joint seam.

9. The encasing of claim 7 wherein the fabric of the web has an air permeability of not greater than 240 liters/m$^2$/min at 196 Pa.

10. The encasing of claim 7 wherein the fabric of the web has a high water vapor permeability.

11. The encasing of claim 7 wherein the lateral seam has allergen-inhibiting impermeability.

12. A method for protection against allergies comprising encasing an object contaminated with respirable fine particles and allergens in the encasing of claim 7.

13. The method of claim 12 wherein the encasing comprises a cover for a latex mattress for protection against latex allergies.

14. An allergen-inhibiting encasing for an object contaminated with respirable fine particles and allergens comprising:

a web having an inner face and having portions defining an opening and having a hem extending along said opening, said web including a fabric coated with foam having a density such that it provides for filtration of particles less than 1 $\mu$m;

a closure device extending along said opening for opening and closing of said encasing thereby allowing for placement of the object in said encasing;

a sealing strip overlapping said closure device and connected to the inner face of the web at said hem, said sealing strip comprising at least three plies of a fabric; and a lateral seam configured such that said hem and sealing strip are connected with each other along said lateral seam.

15. The encasing of claim 14 wherein the fabric of the web has an air permeability of not greater than 240 liters/$m^2$/min at 196 Pa.

16. The encasing of claim 14 wherein the fabric of the web has a high water vapor permeability.

17. The encasing of claim 14 wherein the lateral seam has allergen-inhibiting impermeability.

18. A method for protection against allergies comprising encasing an object contaminated with respirable fine particles and allergens in the encasing of claim 14.

19. The method of claim 18 wherein the encasing comprises a cover for a latex mattress for protection against latex allergies.

20. An encasing device comprising:

an encasement defining an opening;

a closure device for closing said opening; and an overlapping structure on an inner side of said encasement having first and second flaps overlapping one another and said closure device.

21. The encasing of claim 20 wherein said encasement includes a fabric coated with foam having a density such that it provides for filtration of particles less than 1 $\mu$m.

22. The encasing of claim 20 wherein the encasement is impermeable to allergens.

23. A method for protection against allergies comprising encasing an object contaminated with respirable fine particles and allergens in the encasing of claim 22.

24. The encasing of claim 20 wherein said encasing includes a fabric having an air permeability of not greater than 240 liters/$m^2$/min at 196 Pa.

25. The encasing of claim 20 wherein at least one of said first and second flaps is formed of two plies.

* * * * *